US006786423B2

(12) United States Patent
Peterson, Jr.

(10) Patent No.: US 6,786,423 B2
(45) Date of Patent: Sep. 7, 2004

(54) INJECTION VALVE WITH SINGLE DISC TURBULENCE GENERATION

(75) Inventor: William A. Peterson, Jr., Smithfield, VA (US)

(73) Assignee: Siemens Automotive Corporation, Auburn Hills, MI (US)

( * ) Notice: Subject to any disclaimer, the term of this patent is extended or adjusted under 35 U.S.C. 154(b) by 0 days.

(21) Appl. No.: 10/097,627

(22) Filed: Jun. 3, 2002

(65) Prior Publication Data

US 2002/0130193 A1 Sep. 19, 2002

Related U.S. Application Data

(62) Division of application No. 09/568,464, filed on May 10, 2000, now Pat. No. 6,742,727.

(51) Int. Cl.[7] ..... F02D 1/06
(52) U.S. Cl. ..... 239/5; 239/533.12; 239/585.5
(58) Field of Search ..... 239/533.2, 533.3, 239/533.12, 583, 584, 585.4, 585.5, 429, 518, 524, 591, 5

(56) References Cited

U.S. PATENT DOCUMENTS

| | | | | |
|---|---|---|---|---|
| 4,057,190 A | * | 11/1977 | Kiwior et al. | 239/558 |
| 4,925,110 A | * | 5/1990 | Takeda et al. | 239/533.12 |
| 4,925,111 A | | 5/1990 | Foertsch et al. | 239/533.12 |
| 5,244,154 A | | 9/1993 | Bucholz et al. | 239/590.3 |
| 5,516,047 A | | 5/1996 | Kubach et al. | 239/585.5 |
| 5,730,368 A | | 3/1998 | Flik et al. | 239/575 |
| 5,772,124 A | | 6/1998 | Tamaki et al. | 239/533.12 |
| 5,785,254 A | | 7/1998 | Zimmermann et al. | 239/490 |
| 5,862,991 A | | 1/1999 | Willke et al. | 239/397.5 |
| 5,931,391 A | | 8/1999 | Tani et al. | 239/533.12 |
| 6,102,299 A | | 8/2000 | Pace et al. | 239/533.12 |
| 6,170,763 B1 | | 1/2001 | Fuchs et al. | 239/533.12 |
| 6,170,764 B1 | * | 1/2001 | Muller et al. | 239/533.12 |
| 6,364,220 B2 | * | 4/2002 | Willke et al. | 239/585.1 |
| 6,575,382 B1 | * | 6/2003 | Fischer et al. | 239/5 |

FOREIGN PATENT DOCUMENTS

| | | |
|---|---|---|
| JP | 2000-97129 | 9/2000 |
| WO | WO 99/53192 | * 10/1999 |

* cited by examiner

*Primary Examiner*—Christopher Kim

(57) ABSTRACT

A fuel injector for an internal combustion engine is disclosed. The fuel injector includes a housing, a valve seat, a metering orifice, and a needle. The housing has an inlet, an outlet, and a longitudinal axis extending therethrough. The valve seat is disposed proximate the outlet and includes a passage having a sealing surface and an orifice. The metering orifice is located at the outlet and has a plurality of metering openings extending therethrough. The needle is reciprocally located within the housing along the longitudinal axis between a first position wherein the needle is displaced from the valve seat, allowing fuel flow past the needle, and a second position wherein the needle is biased against the valve seat, precluding fuel flow past the needle. A generally annular channel is formed between the valve seat and the metering orifice. The channel tapers outwardly from a large height to a smaller height toward the orifice openings. A method of generating turbulence in a fuel flow through a fuel injector is also disclosed.

10 Claims, 5 Drawing Sheets

$h_1 * r_1 = h_2 * r_2$

INJECTION VALVE WITH SINGLE DISC TURBULENCE GENERATION

The present application is a divisional application filed pursuant to 35 U.S.C. §§120 and 121 and claims the benefits of prior application Ser. No. 09/568,464 filed May 10, 2000, now U.S. Pat. No. 6,742,727, which is hereby incorporated by reference in its entirety.

FIELD OF THE INVENTION

This invention relates to fuel injectors, and more particularly, to fuel injectors having a single disc which generates turbulence at the metering orifices.

BACKGROUND OF THE INVENTION

Fuel injectors are commonly employed in internal combustion engines to provide precise metering of fuel for introduction into each combustion chamber. Additionally, the fuel injector atomizes the fuel during injection, breaking the fuel into a large number of very small particles, increasing the surface area of the fuel being injected and allowing the oxidizer, typically ambient air, to more thoroughly mix with the fuel prior to combustion. The precise metering and atomization of the fuel reduces combustion emissions and increases the fuel efficiency of the engine.

An electromagnetic fuel injector typically utilizes a solenoid assembly to supply an actuating force to a fuel metering valve. Typically, the fuel metering valve is a plunger style needle valve which reciprocates between a closed position, when the needle is seated in a valve seat along a sealing diameter to prevent fuel from escaping through a metering orifice disc into the combustion chamber, and an open position, where the needle is lifted from the valve seat, allowing fuel to discharge through the metering orifice for introduction into the combustion chamber.

Typically, the metering orifice disc includes a plurality of metering orifice openings which are directly below the needle and inward of the sealing diameter. This approach relies on a precise control of the distance between the end of the needle and the upstream surface of the metering orifice disc. Variations in needle geometry, sealing diameter, and lift of the needle can cause this critical dimension to change. Another approach to maintaining precise control of this dimension uses a multi-disc concept. However, this approach has the added complexity of orientation, delamination, and part handling.

It would be beneficial to develop a fuel injector in which a controlled precise geometry is created at the downstream surface of the valve seat to generate desired turbulence at the metering orifice openings.

SUMMARY OF THE INVENTION

Briefly, the present invention is a fuel injector comprising a housing, a valve seat, a metering orifice and a needle. The housing has an inlet, an outlet and a longitudinal axis extending therethrough. The valve seat is disposed proximate the outlet. The valve seat includes a passage having a sealing surface and an orifice. The metering orifice is located at the outlet and includes a plurality of metering openings extending therethrough. The needle is reciprocally located within the housing along the longitudinal axis between a first position wherein the needle is displaced from the valve seat, allowing fuel flow past the needle, and a second position wherein the needle is biased against the valve seat, precluding fuel flow past the needle. A controlled velocity channel is formed between the valve seat and the metering orifice. The controlled velocity channel extends outwardly from the orifice to the plurality of metering openings.

Additionally, the present invention is a method of generating turbulence in a fuel flow through a fuel injector. The method includes providing a fuel flow under pressure to the fuel injector. A valve in the fuel injector is opened and the pressurized fuel flows past the valve and into a fuel chamber. The fuel flow is directed at an initial velocity from the fuel chamber into a controlled velocity channel formed by a valve seat and a metering orifice. The controlled velocity channel tapers from a first height at an upstream end of the controlled velocity channel to a second height at a downstream end of the controlled velocity channel. The second height is smaller than the first height. The fuel maintains a generally controlled velocity through the controlled velocity channel. The final velocity is higher than the initial velocity and generates turbulence within the fuel flow. The fuel flow is then directed through at least one orifice opening downstream of the controlled velocity channel and out of the fuel injector.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain features of the invention. In the drawings.

DETAILED DESCRIPTION OF THE PREFERRED EMBODIMENTS

Figure 1:
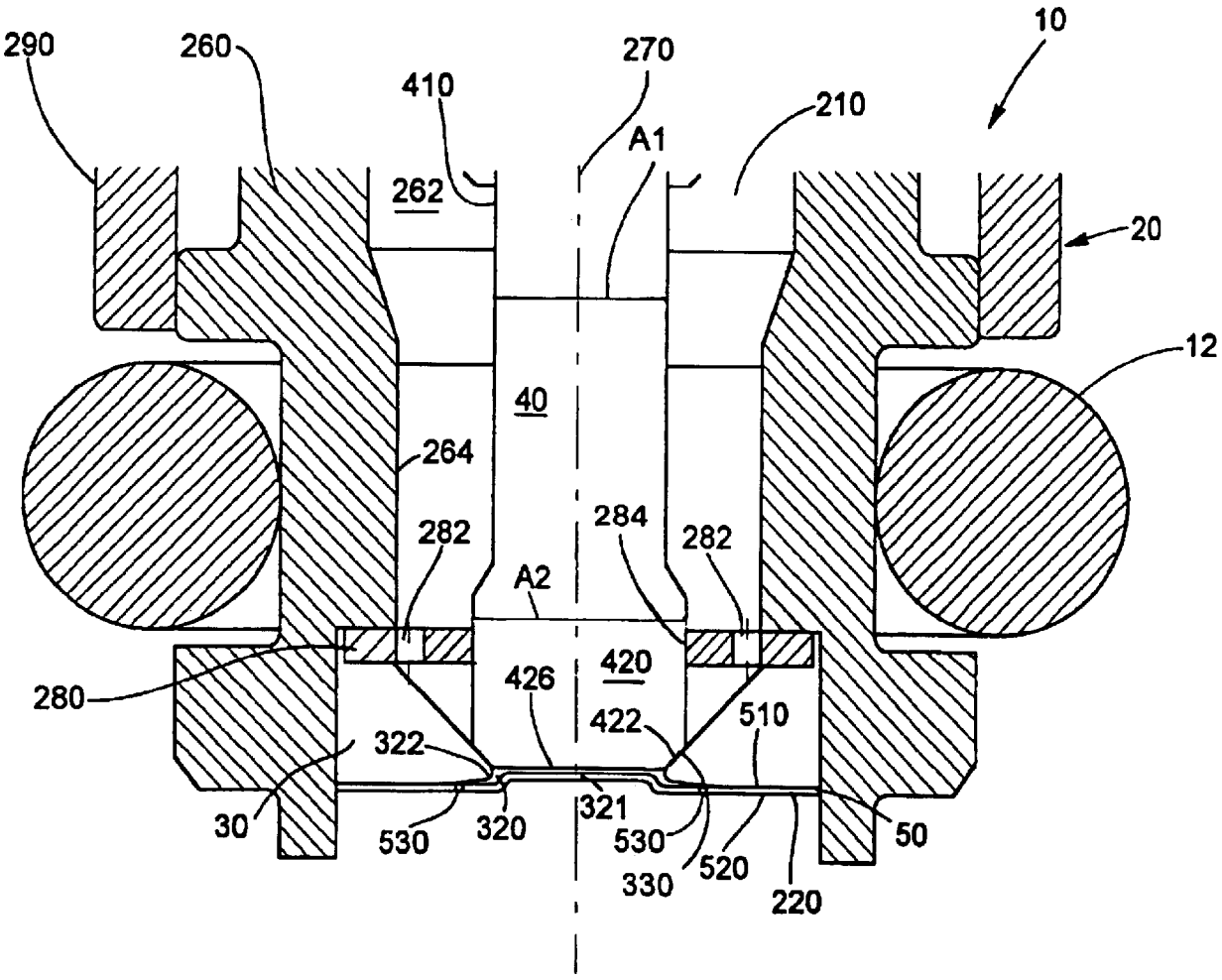
FIG. 1 is a side view, in section, of a discharge end of an injector according to a first embodiment of the present invention, with the needle in the closed position.
Figure 2:
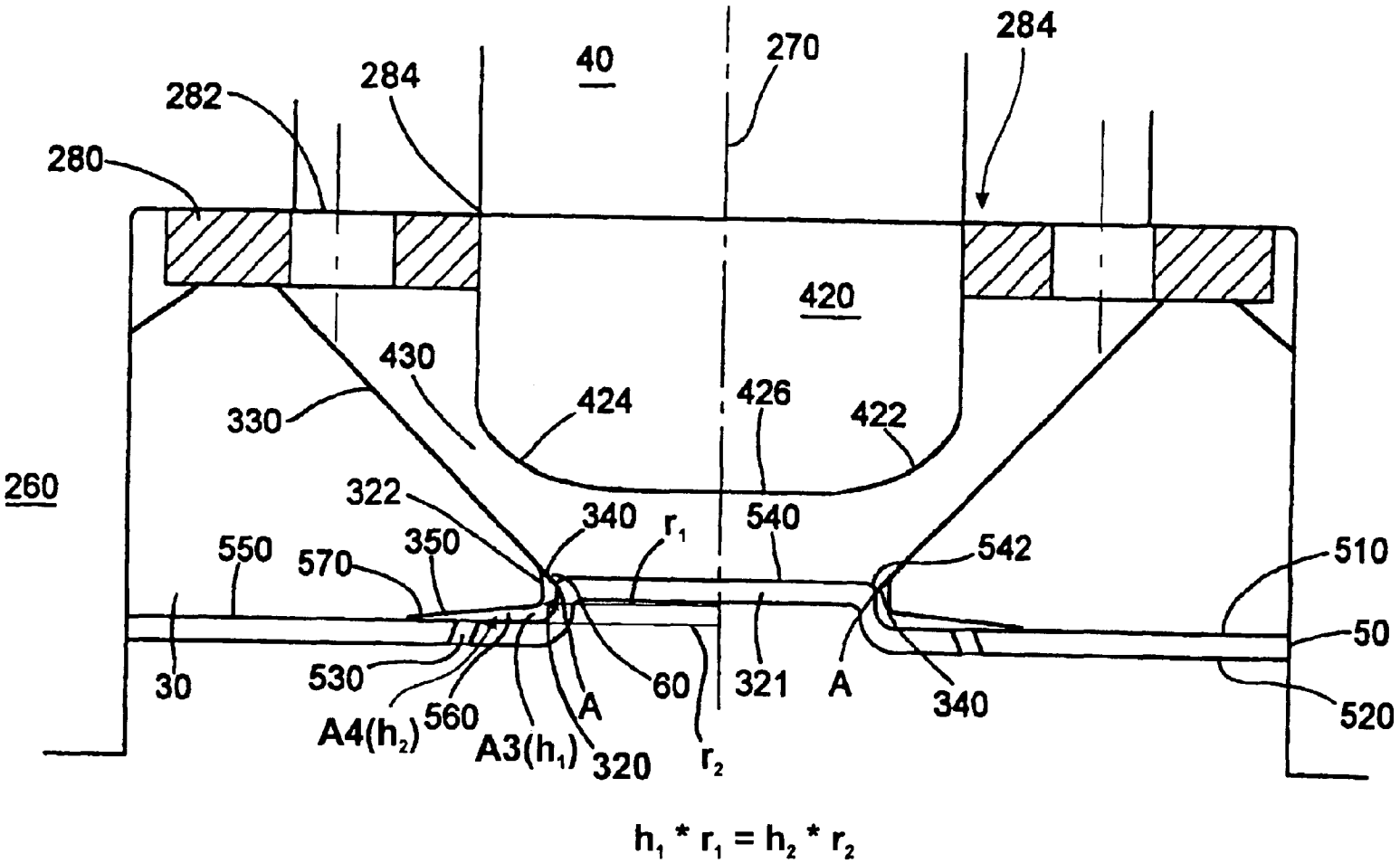
FIG. 2 is an enlarged side view, in section, of the discharge end of the injector of FIG. 1 with the needle in the open position.

In the drawings, like numerals are used to indicate like elements throughout. A first preferred embodiment, shown in FIGS. 1 and 2, is a fuel injector 10 for use in a fuel injection system of an internal combustion engine. The injector 10 includes a housing 20, a valve seat 30, a needle 40, and a generally planar fuel metering orifice 50. Details of the operation of the fuel injector 10 in relation to the operation of the internal combustion engine (not shown) are well known and will not be described in detail herein, except as the operation relates to the preferred embodiments. Although the preferred embodiments are generally directed to injectors for internal combustion engines, those skilled in the art will recognize from present disclosure that the preferred embodiments can be adapted for other applications in which precise metering of fluids is desired or required.

The valve housing 20 has an upstream or inlet end 210 and a downstream or outlet end 220. The housing 20 further includes a valve body 260, which includes a housing chamber 262. The words "upstream" and "downstream" designate flow directions in the drawings to which reference is made. The upstream side is toward the top of each drawing and the downstream side is toward the bottom of each drawing. The housing chamber 262 extends through a central longitudinal portion of the valve housing 20 along a longitudinal axis 270 extending therethrough and is formed by an interior housing wall 264. A needle guide 280 having a central needle guide opening 284 and a plurality of radially spaced fuel flow openings 282 is located within the housing chamber 262 proximate to the downstream end 220 of the housing 20. The needle guide assists in maintaining reciprocation of the needle 40 along the longitudinal axis 270. An overmold 290 constructed of a dielectric material, preferably a plastic or other suitable material, encompasses the valve body 260. An o-ring 12 is located around the outer circumference of the valve body 260 to seat the injector 10 in the internal combustion engine (not shown).

The valve seat 30 is located within the housing chamber 262 proximate to the outlet end 220 between the needle guide 280 and the discharge ends 220. The valve seat 30 includes a passage orifice 320 which extends generally along the longitudinal axis 270 of the housing 20 and is formed by a generally cylindrical wall 322. Preferably, a center 321 of the orifice 320 is on the longitudinal axis 270. The valve seat 30 also includes a beveled sealing surface 330 which surrounds the orifice 320 and tapers radially downward and inward toward the orifice 320 such that the sealing surface 330 is oblique to the longitudinal axis 270. The words "inward" and "outward" refer to directions towards and away from, respectively, the longitudinal axis 270.

The needle 40 is reciprocally located within the housing chamber 262 generally along the longitudinal axis 270 of the housing 20. The needle 40 is reciprocable between a first, or open, position wherein the needle 40 is displaced from the valve seat 30 (as shown in FIG. 2), allowing pressurized fuel to flow downstream past the needle 40, and a second, or closed, position wherein the needle 40 is biased against the valve seat 30 (as shown in FIG. 1) by a biasing element (not shown), preferably a spring, precluding fuel flow past the needle 40.

The needle 40 includes a first portion 410 which has a first cross-sectional area A1 and a second portion 420 which has a second cross-sectional area A2. The second portion 420 includes a generally spherical valve contact face 422 which is sized to sealingly engage the beveled valve sealing surface 330 when the needle 40 is in the closed position. The spherical valve contact face 422 engages the beveled valve sealing surface 330 to provide a generally line contact therebetween. The line contact provides a solid seal between the needle 40 and the valve seat 30 and reduces the possibility of fuel leakage past the needle 40. The contact face 422, shown in enlarged FIG. 2, connects with a planar end face 426 located at a downstream tip of the needle 40. The end face 426 is preferably generally perpendicular to the longitudinal axis 270 of the housing 20.

Preferably, both the first and second cross-sectional areas A1, A2 are circular, although those skilled in the art will recognize that the first and second cross-sectional areas A1, A2 can be other shapes as well. This configuration reduces the mass of the needle 40 while retaining a relatively large sealing diameter of the valve contact face 422 so as to provide a relatively generous sealing area of the needle 40 for engagement of the valve contact face 422 when the needle 40 is in the closed position. The increased cross-sectional area A2 of the needle also provides a larger guide surface relative to the mean needle diameter, thereby improving the wear resistance of the internal surface of the central needle guide opening 284. The improved wear resistance of the internal surface of the central needle guide opening 284 is due to reduced loading compared to that of a conventional base valve guide diameter which was used with prior art needles of a generally constant cross-sectional area. For example, a typical prior art needle will have a substantially continuous cylindrically shaped shaft which terminates at an end portion wherein the cross-sectional area at the upper portion of the needle may be twice as much as the cross-sectional area A2 of the needle 40 shown in FIG. 2.

The needle 40 is reciprocable between the closed position (shown in FIG. 1) and the open position (shown in FIG. 2). When the needle 40 is in the open position, a generally annular channel 430 is formed between the valve contact face 422 and the valve sealing surface 330.

The metering orifice 50 is located within the housing chamber 262 and is connected to the housing 20, downstream of the valve seat 30. The metering orifice 50 has an interior face 510 facing the valve seat 30 and the needle 40, and an exterior face 520 facing the combustion chamber (not shown). A plane of the metering orifice 50 is generally parallel to the plane of the planar end face 426.

Figure 3:
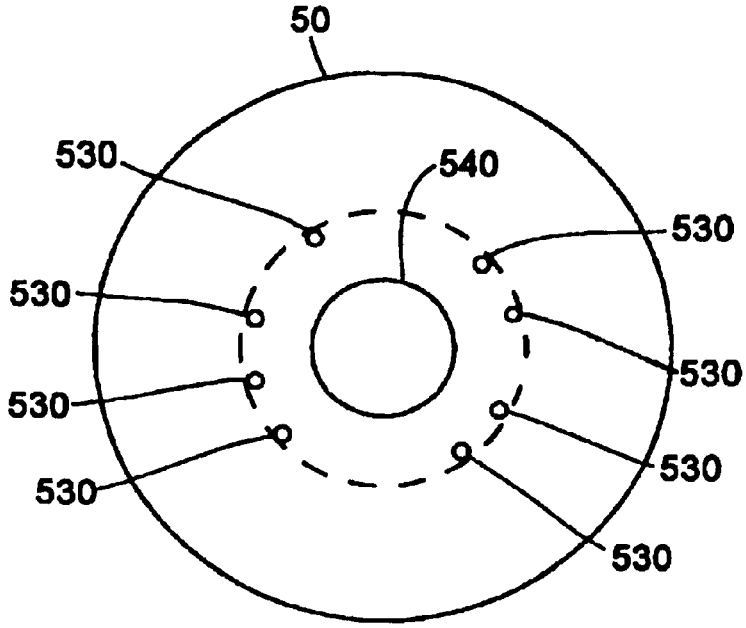
FIG. 3 is a top plan view of a metering orifice used in the injector shown in FIG. 1.

A virtual extension 340 of the valve seat 30 can be projected onto the metering orifice 50 so as to intercept the interior face 510 of the metering orifice 50 at a point "A", shown in FIG. 2. Referring now to FIG. 3, although eight metering openings 530 are shown, the metering orifice 50 preferably includes between four and twelve generally circular metering openings 530, although those skilled in the art will recognize that the metering orifice 50 can include less than four or more than twelve metering openings 530, and that the metering openings 530 can be other shapes, such as oval or any other suitable shape. Preferably, a distance between adjacent metering openings 530 is at least approximately two and a half times as great as a diameter of the metering openings 530, although those skilled in the art will recognize that the distance between adjacent metering openings 530 can be less than that amount.

The metering orifice 50 includes a raised portion 540 located within a perimeter determined by the metering openings 530. Preferably, in the closed position, the raised portion 540 of the metering orifice 50 and the end face 426 are spaced from each other by between 50 microns and 250 microns, and, more preferably, by between 50 and 100 microns, although those skilled in the art will recognize that the distance can be less than 50 microns or greater than 100 microns. The raised portion 540 is preferably circular and reduces the sac volume 60 between the metering orifice 50 and the planar end face 426 of the needle 40. However, those skilled in the art will recognize that the raised portion 540 can be other shapes, such as oval. A continuous annular gap 542 is formed between the raised portion 540 and the orifice opening 330 in the valve seat 30. The gap 542 allows fuel flow between the metering orifice 50 and the valve seat 30 when the needle 40 is in the open position.

Downstream of the circular wall 322, the valve seat 30 tapers along a tapered portion 350 downward and outward in an oblique manner away from the orifice 320 to a point radially past the metering openings 530, where the valve seat 30 flattens to a bottom surface 550 preferably perpendicular to the longitudinal axis 270. The valve seat orifice 320 is preferably located wholly within the perimeter determined by the metering openings 530. The interior face 510 of the metering orifice 50 proximate to the outer perimeter of the metering orifice 50 engages the bottom surface 550 along a generally annular contact area.

Referring to FIG. 2, a generally annular controlled velocity channel 560 is formed between the tapered portion 350 of the valve seat 30 and interior face 510 of the metering orifice 50. Preferably, the controlled velocity channel 560 provides a generally constant velocity, although those skilled in the art will recognize that the controlled velocity can vary throughout the length of the channel 560. The channel 560 tapers outwardly from a larger height A3 at the orifice 320 to a smaller height A4 toward the metering openings 530. The reduction in the height toward the metering openings 530 maintains the fuel at a generally controlled velocity, as will be discussed in more detail below, forcing the fuel to travel in a transverse direction across the metering openings 530, where the fuel is atomized as it passes through the metering openings 530 into the combustion chamber (not shown). A generally annular space 570 is formed between the interior face 510 of the metering orifice 50 radially outward of the metering openings 530 and the tapered portion 350 of the valve seat 30.

In operation, pressurized fuel is provided to the injector 10 by a fuel pump (not shown). The pressurized fuel enters the injector 10 and passes through a fuel filter (not shown) to the housing chamber 262. The fuel flows through the housing chamber 262, the fuel flow openings 284 in the guide 280 to the interface between the valve contact face 422 and the valve sealing surface 330. In the closed position, the needle 40 is biased against the valve seat 30 so that the valve contact face 422 sealingly engages the valve sealing surface 330, preventing flow of fuel through the metering orifice 50.

In the open position, a solenoid or other actuating device, (not shown) reciprocates the needle 40 to an open position, removing the spherical contact face 422 of the needle 40 from the sealing surface 330 of the valve seat 30 and forming the generally annular channel 430. Pressurized fuel within the housing chamber 262 flows past the generally annular channel 430 formed by the needle 40 and the valve seat 30 and impinges on the raised portion 540 of the metering orifice 50. The fuel then flows generally radially outward along the raised portion 540 of the metering orifice 50 from the longitudinal axis 270, where the flow is redirected generally downward between the raised portion 540 and the valve seat orifice walls 322. The fuel is then directed generally radially outward from the longitudinal axis 270 through the generally annular channel 560 between the tapered portion 350 of the valve seat 30 and the metering orifice 50. The fuel attains a generally high velocity at the beginning of the generally annular channel 560. As the fuel flows outward from the longitudinal axis 270, the perimeter of the fuel flow increases in a direct linear relationship to the distance from the longitudinal axis 270. To maintain a generally constant area of fuel flow, the height between the metering orifice 50 and the tapered portion 350 of the valve seat 30 must decrease (as shown in the decreased height A4 as compared to height A3 in FIG. 2) according to the formula:

$$2\pi r_1 h_1 = 2\pi r_2 h_2 \qquad \text{Equation 1}$$

where:

$r_1$ is a radius of the fuel flow between the longitudinal axis 270 and location A3;

$h_1$, is a height between the metering orifice 50 and the tapered portion 350 at location A3;

$r_2$ is a radius of the fuel flow between the longitudinal axis 270 and location A4; and $h_2$ is a height between the metering orifice 50 and the tapered portion 350 at location A4.

Although a generally constant flow velocity is desired, those skilled in the art will recognize that the generally annular channel 560 can be used to accelerate or decelerate the velocity of the fuel if desired.

As the fuel flows across the metering openings 530, turbulence is generated within the fuel flow which reduces the spray particle size, atomizing the fuel as it flows through the metering openings 530 into the combustion chamber (not shown).

When a pre-determined amount of fuel has been injected into the combustion chamber, the solenoid or other actuating device disengages, allowing the spring (not shown) to bias the needle 40 to the closed position, closing the generally annular channel 430 and seating the valve contact face 422 of the needle 40 onto the sealing surface 330 of the valve seat 30.

Figure 4:
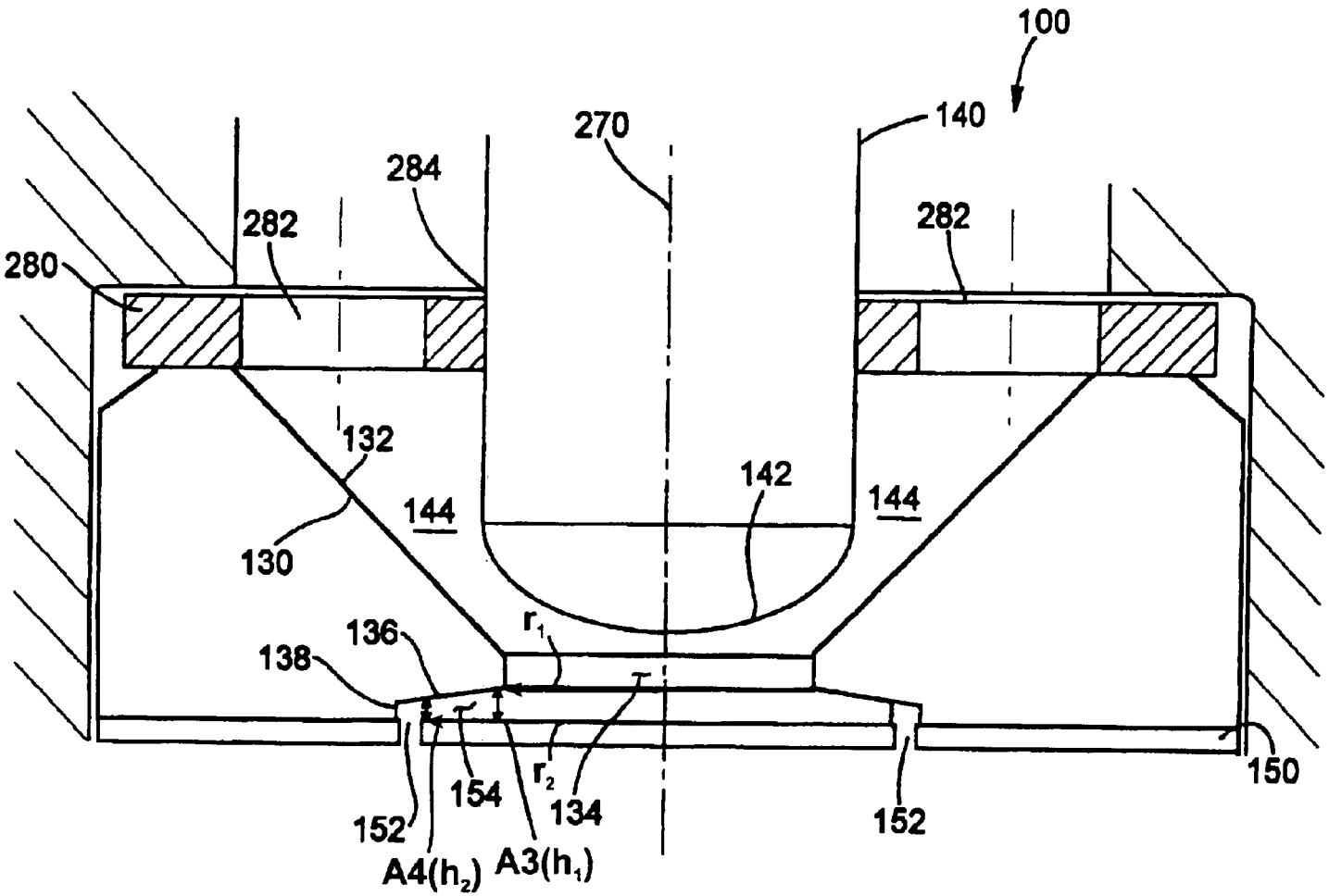
FIG. 4 is a side view, in section, of a discharge end of an injector according to a second preferred embodiment of the present invention.

A second embodiment 100 is shown in FIG. 4. In the second embodiment, the valve seat 130 includes a valve sealing surface 132 and a valve orifice 134. The valve seat 130 is generally the same shape as the valve seat 30, with a tapered portion 136 which extends downward and outward in an oblique manner from the longitudinal axis 270 downstream from the valve orifice 134. The tapered portion 134 terminates at a location radially outward of the metering orifice openings 152. A generally annular controlled velocity channel 154 is formed between the metering orifice 150 radially outward of the metering openings 152 and the tapered portion 136 of the valve seat 130.

The needle 140 differs from the needle 40 in the first embodiment in that the needle tip 142 does not include a flat end face. However, those skilled in the art will recognize that either of the needles 40, 140 can have a spherical, conical, tapered, flat, or other, suitable tip. When the needle 140 is in the closed position, the needle tip 142 engages the valve seat 130 in a generally circular point contact. When the needle 140 is in the open position, a generally annular channel 144 is formed between the needle 140 and the valve seat 130.

Figure 5:
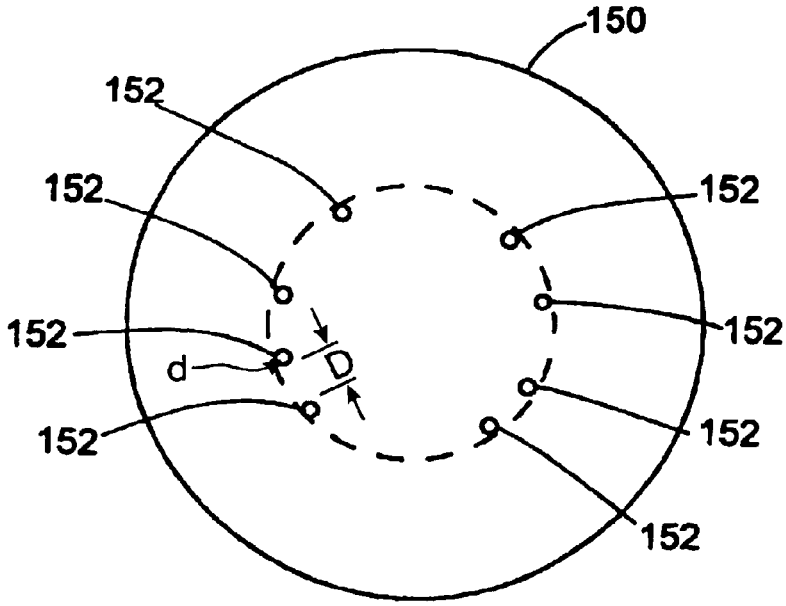
FIG. 5 is a top plan view of a metering orifice used in the injector shown in FIG. 4.

The metering orifice 150, shown in a top plan view in FIG. 5, is generally planar and extends in a plane generally perpendicular to the longitudinal axis 270. The metering orifice 150 differs from the metering orifice 50 in that the metering orifice 150 does not include a raised portion 540.

In operation, when the needle 140 is lifted from the valve seat 130, pressurized fuel flows through the channel 144 formed between the needle 140 and the valve seat 130. The fuel is directed into the valve seat orifice 134 and to the metering orifice 150. The fuel then is directed outward from the longitudinal axis 270 into the controlled velocity channel 154 where the fuel attains a high velocity at the entrance of the controlled velocity channel 154. The high fuel velocity directs the fuel across the metering orifice 150 and the orifice openings 152 in a transverse direction to the orifice openings 152, generating turbulence within the fuel which atomizes the fuel as the fuel travels through the orifice openings 152.

Figure 6:
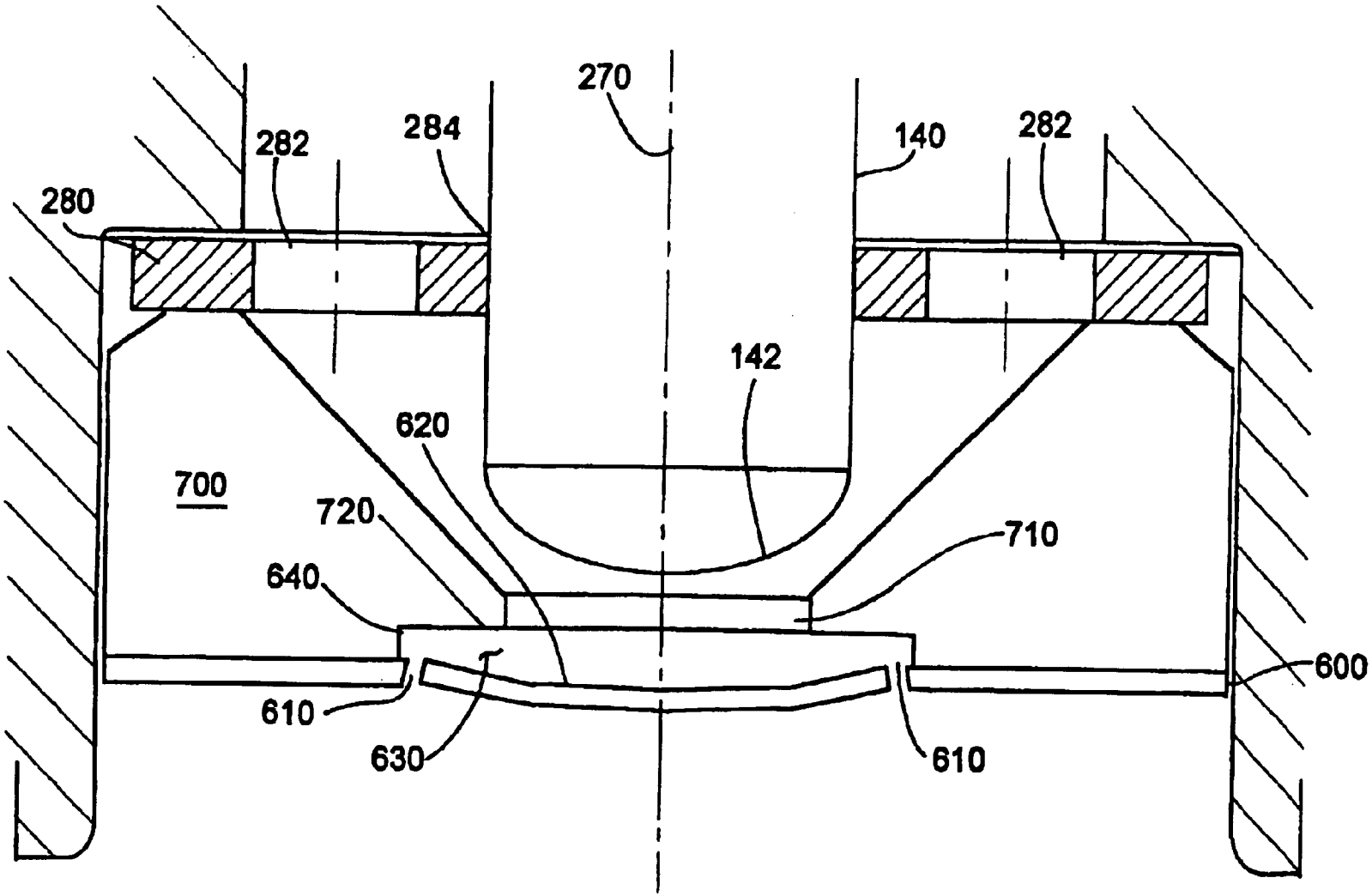
FIG. 6 is a side view, in section, of a discharge end of an injector according to a third preferred embodiment of the present invention.

The third embodiment, shown in FIG. 6, is similar to the second embodiment with the exception that, in the third embodiment, a metering orifice 600 between orifice openings 610 is generally rounded such that a concave surface 620 faces the needle 140. The valve seat 700, instead of tapering downward and outward in an oblique manner away from the longitudinal axis 270 below a valve seat orifice 710 along a bottom portion 720, preferably extends away from the longitudinal axis 270 generally perpendicular to the longitudinal axis 270. A generally annular channel 630 is formed between the bottom portion 720 of the valve seat 700 and the metering orifice 600. The channel 630 tapers outwardly from a larger height to a smaller height toward the orifice openings 610. A generally annular space 640 is formed between the metering orifice 600 radially outward of the metering openings 610 and the bottom portion 720 of the valve seat 700.

The operation of the third embodiment is similar to the operation of the second embodiment described above.

Although the three preferred embodiments described above disclose generally annular channels formed between the valve seat and the metering orifice in which the channel tapers outwardly from a larger height to a smaller height toward the orifice openings to maintain a generally constant cross-sectional area, those skilled in the art will recognize that generally annular channels which taper outwardly from a larger height to a smaller height toward the orifice openings can be formed in other manners.

Preferably, in each of the embodiments described above, the valve seat 30, the needle 40, and the metering orifice 50 are each constructed from stainless steel. However, those skilled in the art will recognize that the valve seat 30, the needle 40 and the metering orifice 50 can be constructed of other, suitable materials.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined in the appended claims.

What is claimed is:

1. A method of generating turbulence in a fuel flow through a fuel injector, the method including the steps of:

providing a fuel flow under pressure along a longitudinal axis to the fuel injector;

opening a valve in the fuel injector and allowing the pressurized fuel to flow past a sealing surface of the valve and into a seat orifice, the sealing surface defining a virtual projection that intersects a surface of a metering orifice disc prior to intersecting the longitudinal axis;

flowing fuel at an initial velocity from the seat orifice into a controlled velocity channel formed by the valve and the metering orifice disc along a tapered portion of the controlled velocity channel as the channel tapers from a first height at an upstream end of the controlled velocity channel between the seat orifice and the metering disc to a second height between the tapered portion and the metering disc at a downstream end of the tapered portion, the second height being smaller than the first height, the fuel generally maintaining a generally constant velocity through the controlled velocity channel between the seat orifice and proximate at least one metering orifice of the metering orifice disc; and directing the fuel flow through the at least one metering orifice opening spaced from the longitudinal axis and downstream of the controlled velocity channel, and out of the fuel injector.

2. The method according to claim 1, wherein the directing includes maintaining a first fuel flow area of the fuel flow proximate the seat orifice through the controlled velocity channel to a second fuel flow area proximate the metering orifice at a generally constant area of fuel flow.

3. The method according to claim 1, wherein the upstream end of the controlled velocity channel is located at a first radius from a longitudinal axis and the downstream end of the controlled velocity channel is located a second radius from the longitudinal axis such that the first radius is smaller than the second radius.

4. The method of claim 1, wherein the opening of a valve comprises flowing fuel past a needle into the seat orifice, the seat orifice having a wall surface defining a first circumference disposed generally orthogonal about the longitudinal axis; and wherein the directing comprises maintaining the generally constant velocity of fuel flow through the controlled velocity channel formed by a seat surface confronting a metering orifice disc surface on which the at least one metering orifice is located therethrough, the at least one metering orifice including a plurality of metering orifices surrounding a second circumference generally orthogonal about the longitudinal axis, the controlled velocity channel having a first flow area and a second flow area generally equal to the first flow area, the first flow area defined by a product of the first circumference and a first distance of a virtual extension of the first circumference along the longitudinal axis between the seat surface and the metering disc, and the second flow area defined by a product of the second circumference and a second distance of a virtual extension of the second circumference along the longitudinal axis between the seat surface and the metering disc.

5. The method of claim 4, wherein the maintaining comprises flowing fuel through the seat orifice along a generally planar seat surface that confronts the metering orifice disc towards the plurality of metering orifices.

6. The method of claim 5, wherein the flowing comprises directing fuel to each of the plurality of metering orifices extending through the metering orifice disc and oblique to the longitudinal axis.

7. The method of claim 6, wherein the metering orifice disc comprises a portion tapered with respect to the longitudinal axis.

8. The method of claim 4, wherein the maintaining comprises flowing fuel through the seat orifice along a tapered surface that confronts the metering orifice disc towards the plurality of metering orifices.

9. The method of claim 8, wherein the flowing comprises directing fuel to plurality of metering orifices extending through the metering orifice disc and generally parallel to the longitudinal axis.

10. The method of claim 8, wherein the metering orifice disc comprises a generally planar portion with respect to the longitudinal axis.

* * * * *

UNITED STATES PATENT AND TRADEMARK OFFICE

CERTIFICATE OF CORRECTION

PATENT NO. : 6,786,423 B2
DATED : September 7, 2004
INVENTOR(S) : Peterson, Jr.

It is certified that error appears in the above-identified patent and that said Letters Patent is hereby corrected as shown below:

Title page,
Item [22], PCT Filed, change the date to -- March 15, 2002 --

Signed and Sealed this

Twenty-fourth Day of May, 2005

JON W. DUDAS
*Director of the United States Patent and Trademark Office*